US008360259B2

(12) United States Patent
Chang

(10) Patent No.: US 8,360,259 B2
(45) Date of Patent: Jan. 29, 2013

(54) AUTOMATIC OPENING-AND-CLOSING DISCHARGING STRUCTURE FOR A LOOSE POWDER JAR

(76) Inventor: Chia-Sheng Chang, Taichung (TW)

( * ) Notice: Subject to any disclaimer, the term of this patent is extended or adjusted under 35 U.S.C. 154(b) by 216 days.

(21) Appl. No.: 13/011,929

(22) Filed: Jan. 24, 2011

(65) Prior Publication Data

US 2012/0187124 A1 Jul. 26, 2012

(51) Int. Cl.
*B65D 51/18* (2006.01)
*B65D 51/20* (2006.01)
*B65D 88/54* (2006.01)

(52) U.S. Cl. ..... 220/254.9; 220/259.5; 220/256.1; 222/516

(58) Field of Classification Search ..... 215/342; 220/203.1, 254.1, 254.3, 254.8, 254.9, 256.1, 220/259.4, 259.5, 288–304, 500–557; 222/513, 222/516, 498–499, 486, 481, 480, 478, 239, 222/230, 226

See application file for complete search history.

(56) References Cited

U.S. PATENT DOCUMENTS 1,066,813 A * 7/1913 Heldrich ..... 222/516
1,154,518 A * 9/1915 Kendall ..... 222/516
1,588,870 A * 6/1926 Aulbach ..... 222/516
2,636,649 A * 4/1953 Clarence ..... 222/516
3,125,214 A * 3/1964 Merila ..... 206/0.8
3,410,462 A * 11/1968 Donovan ..... 222/516
3,601,250 A * 8/1971 Merila ..... 206/540
4,643,881 A * 2/1987 Alexander et al. ..... 422/265
4,836,424 A * 6/1989 Afshar ..... 222/279

* cited by examiner

*Primary Examiner* — J. Gregory Pickett
*Assistant Examiner* — Kaushikkumar Desai
(74) *Attorney, Agent, or Firm* — Leong C. Lei

(57) ABSTRACT

An automatic opening-and-closing discharging structure for a loose powder jar in which a discharging porous face can be automatically opened and closed based on a makeup demand. In this design, overlapped fixed and movable trough plates having opposite discharging porous faces are arranged at a filling port of a jar body. Long and short arc grooves are disposed oppositely at an external perimeter of the porous face of the fixed trough plate, wherein an elastic member is disposed in each long arc groove. Convex inserted columns are inserted at the bottom of the movable trough plate corresponding to the positions of the long and short arc grooves, so as to form a rotation control guide. Convex points are preset on a top-edge ring plate of the movable trough plate, so that when a jar cover is locked, the discharging is closed by dislocation and disconnection of the porous faces as the cover body rotates.

8 Claims, 5 Drawing Sheets

AUTOMATIC OPENING-AND-CLOSING DISCHARGING STRUCTURE FOR A LOOSE POWDER JAR

BACKGROUND OF THE INVENTION (a) Technical Field of the Invention

The present invention relates to an improved automatic opening-and-closing discharging structure for a loose powder jar, wherein a discharging structure consisting of overlapped upper and lower trough plates is disposed at an edge of a filling port on a top of a body of a cosmetic powder packing jar. Around an external perimeter of a discharging porous face of the lower fixed trough plate in the overlapped structure, opposite long and short arc grooves are uniformly disposed, so that inserted columns can be inserted at corresponding positions of a bottom of a movable trough plate, and with an elastic member preset in the arc groove, the movable trough plate is bulged with convex points disposed on a placing ring plate. A rotation of the movable trough plate is controlled by the locking of a jar cover, so that the overlapped upper and lower porous faces are naturally dislocated to close the discharging.

(b) Description of the Prior Art

In general, in a conventional discharging structure design of a cosmetic powder packing jar, a cover plate with a discharging porous face is disposed at an opening edge of a jar tank. For the convenience of storing cosmetic brushes, a cover plate sheet is designed to have a concave groove at its center, so that the cosmetic brushes can be stored in the concave part thereof and an appropriate block of an actual discharging hole is naturally formed for preventing the powder from dropping out. Moreover, at the opening of the jar tank, a jar cover is used as a locking seal. In this way, a safe packing is achieved. However, in this design, not only the contained powder is easy to spill over due to inversion, thus wastefully making the whole cosmetic brush attached with the powder, but also it is inconvenient to open the jar. Accordingly, some producers directly design a double-layer discharging plate face on the top, i.e. a discharging design like a prickly heat powder jar. However, the powder jar should be opened or closed by a manual rotation before or after using. After using, if it is forgotten to close the jar by rotating, a case of spilling over as described above may occur. When the powder is carried outside or used actually for fixing the makeup, generally the action should be fast and a case of making hands attached with the powder is not allowed to occur. Otherwise, the whole operation of fixing the makeup will be affected. Therefore, in terms of the discharging design of a conventional loose powder jar, there is still space for further improving a discharging opening-and-closing operation of the loose powder jar, so as to achieve an automatic and convenient usage, without making the hands attached with the powder. This is also a development and improvement objective actively considered by producers all the time.

SUMMARY OF THE INVENTION

As a professional cosmetic tool developer and manufacturer, for so many years, the inventor is deeply aware of usage defects of a cosmetic powder jar during actual use. With special regard to many defects in practicability of the above powder jar containers during a discharging control, after considerable research and improvement, the inventor finally develops the improved automatic opening-and-closing discharging structure for a loose powder jar of the present invention. Different long and short arc grooves are directly disposed at an external perimeter of a discharging hole on an overlapped lower fixed trough plate, so as to preset an elastic member in the long arc groove, so that convex points disposed on a top-edge ring plate of an overlapped movable trough plate can rotate jointly along with a jar cover to close the discharging hole. When the jar cover is opened and released, an opening position of the discharging hole can be recovered flexibly and simultaneously. Thus, a safe automatic opening-and-closing operation can be performed during makeup, and the inconvenience due to uncontrolled discharging during use of the current powder jar for makeup can be effectively overcome.

The present invention mainly aims to provide a convenient and practical design. In this design, depending on a demand for taking powder for makeup, after the packed jar cover is opened, the discharging hole is automatically and simultaneously opened, and when the jar cover is closed and locked after using, the discharging hole can be simultaneously dislocated and closed by rotating, thereby achieving an automatic coordinated control of cosmetic taking. Thus, when used for makeup, the powder jar is convenient, safe for storing, and practical.

DETAILED DESCRIPTION OF THE PREFERRED EMBODIMENTS

Figure 1:
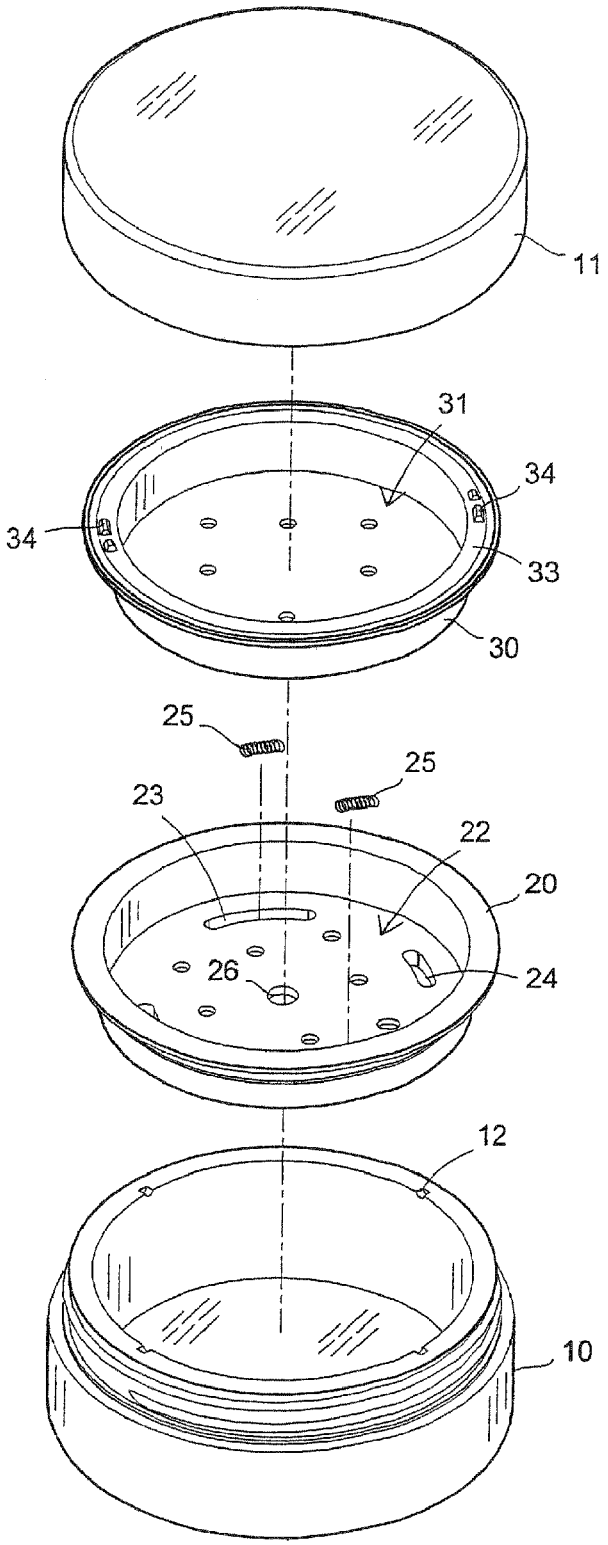
FIG. 1 is an exploded perspective view showing an assembly of the powder jar structure of the present invention.
Figure 2:
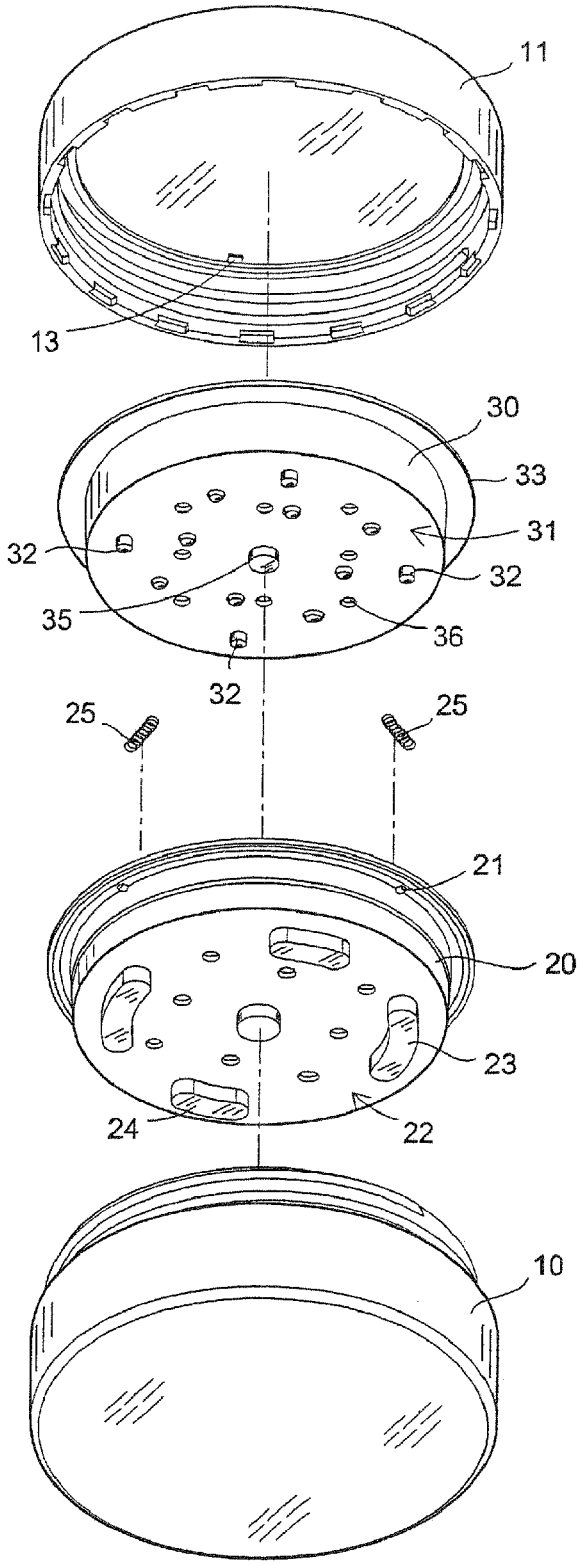
FIG. 2 is an exploded perspective reference view showing an assembly of the powder jar structure of the present invention from another angle.
Figure 3:
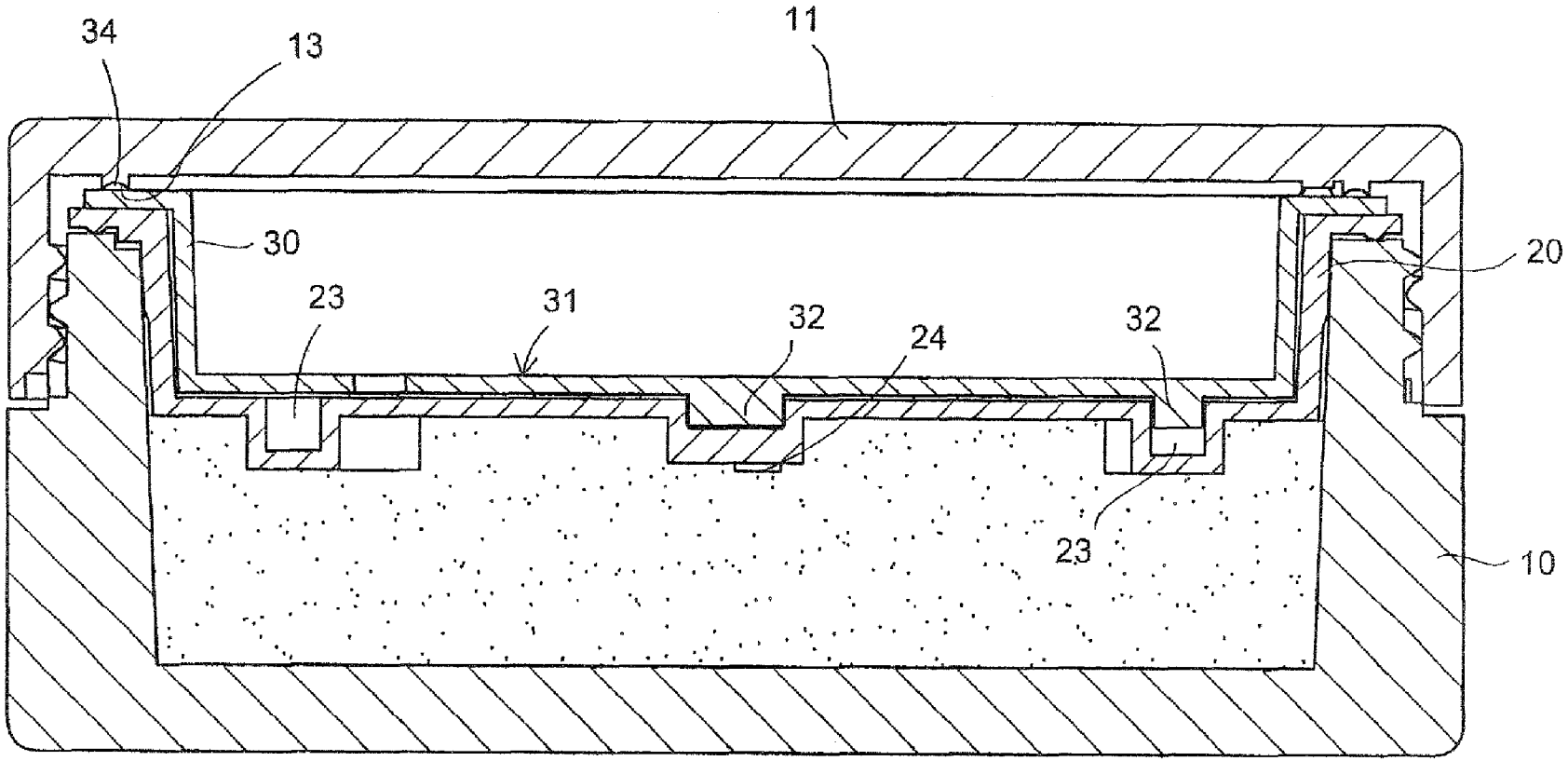
FIG. 3 is a plan reference view showing a locking assembly of the powder jar structure of the present invention.
Figure 4:
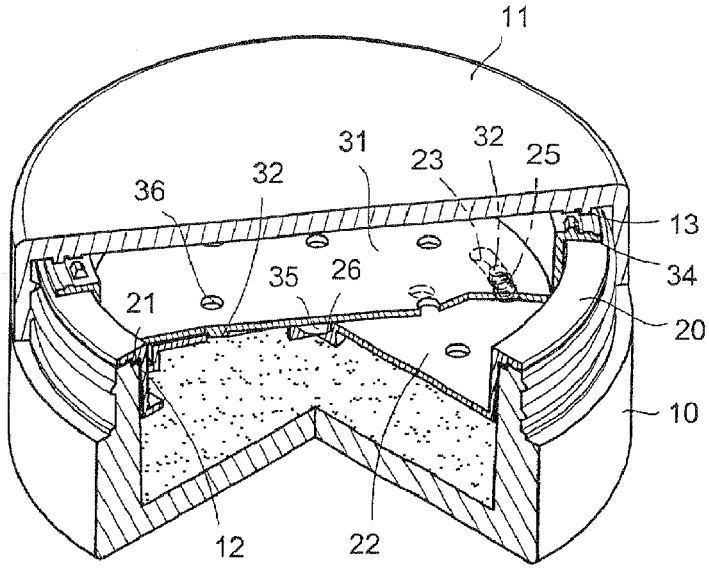
FIG. 4 is a sectional reference view showing a perspective part of the powder jar of the present invention before the jar cover is locked.
Figure 5:
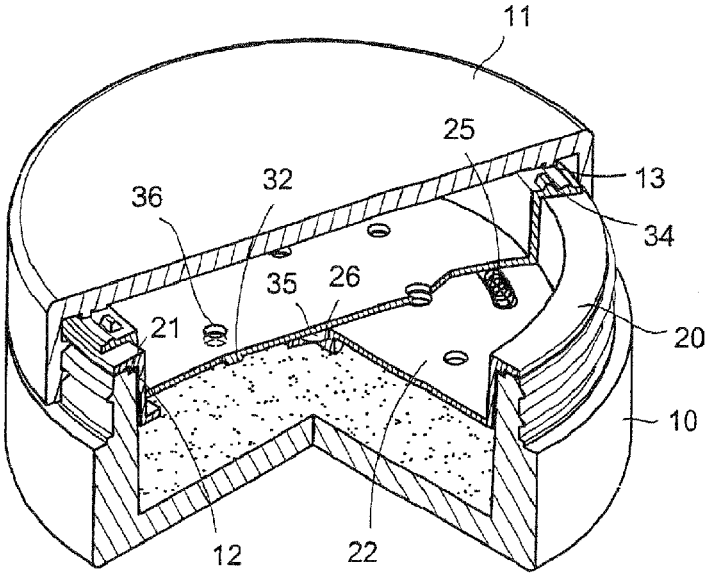
FIG. 5 is a sectional reference view showing a perspective part of the powder jar of the present invention before the jar cover is released and opened.
Figure 6:
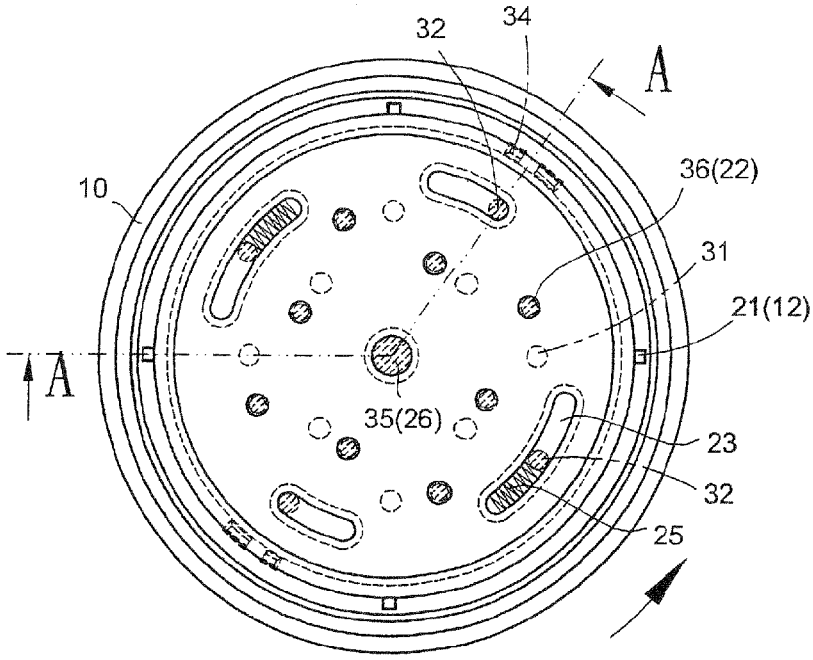
FIG. 6 is a plan reference view showing an assembly of the powder jar of the present invention after the discharging is closed.
Figure 7:
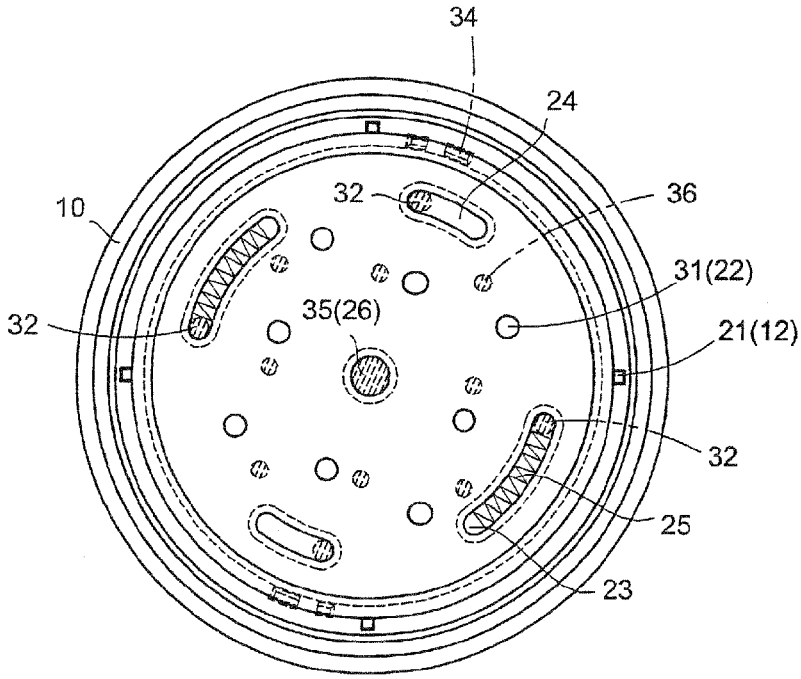
FIG. 7 is a plan reference view showing an assembly of the powder jar of the present invention after the discharging is opened.

The present invention relates to an improved automatic opening-and-closing discharging structure for a loose powder jar. With reference to FIGS. 1-7, the improved structure design includes a hollow jar body 10 for storing a loose powder, and a jar cover 11 for closing. Multiple concave positioning notches 12 are uniformly disposed at an inner edge of a filling port of the jar body 10. In this way, convex points 21 disposed at corresponding positions on a bottom surface of a circularly-arranged groove edge on a fixed trough plate 20 with a concave pateriform shape can be inserted into the concave positioning notches 12, thereby providing assistance in placing and positioning for assembling the fixed trough plate 20. A discharging porous face 22 formed by distributing and arranging many through holes is disposed on a central concave plate face of the fixed trough plate 20. Opposite long and short concave arc grooves 23 and 24 are uniformly disposed on a circularly-arranged external face of the discharging porous face 22, wherein an elastic member 25 with an appropriate length is disposed at an inner edge of the long arc groove 23. The elastic member 25 is generally a spring with an appropriate winding length that is slightly shorter than the whole length of the arc groove. An appropriate interval space for filling is retained for a movable trough plate 30 to be overlapped above the fixed trough plate 20, wherein the movable trough plate 30 and the fixed trough plate 20 have the same shape. A corresponding porous face 31 is disposed on the movable trough plate 30 for forming a combined discharging hole path which connects the upper and lower trough plates. Furthermore, at positions on a bottom plate face of the movable trough plate 30 corresponding to the long arc groove 23 and the short arc groove 24, convex inserted columns 32 are respectively disposed for being inserted respectively into the arc grooves, thereby forming an overlapped rotating-and-sliding guide. When rotating, the inserted column 32 inserted in the long arc groove 23 can rest against and push the elastic member 25 to perform an operation of compression and contraction. In addition, at appropriate positions above a top-edge ring plate 33 of the movable trough plate 30, convex points 34 are disposed uniformly at regular intervals, which can be mutually engaged and jointly moved with the corresponding convex points 13 circularly arranged on the jar cover 11. In this way, when the jar cover 11 is screwed to a locked position, the movable trough plate 30 can rotate simultaneously, thereby achieving the rotation of the movable trough plate 30. Thus, the overlapped upper and lower discharging holes on the overlapped trough plates form a dislocated and disconnected discharging-suspension state to provide a safe use structure for the powder jar packing. In order to make the overlapped discharging seal more reliable and make the rotation control smooth, an axle center groove 26 is disposed at the center of the fixed trough plate 20, and a convex axle column 35 disposed at the bottom center of the movable trough plate 30 is inserted into the groove 26 for assistance in a stable concentric axle rotation. Furthermore, on the bottom face of the movable trough plate 30, slightly convex flanges 36 uniformly arranged are distributed at intervals of through holes, and the sphere arc-shaped convex granule surface thereof are slightly convex. In this way, when the overlapped upper and lower holes of the overlapped trough plates form a dislocated and disconnected discharging-suspension state, the flanges 36 just can be inserted into the opening edges of the through holes of the fixed trough plate 20, thereby reliably sealing the discharging and making the powder jar packing safe for storing materials. During makeup, when the jar cover 11 is rotated and released, through an elastic recovery of the elastic member 25 disposed in the long arc groove 23, the movable trough plate 30 is reliably rotated back to the original position, i.e. the discharging state where the overlapped upper porous face 31 and lower porous face 22 are connected with each other. Thus, it is ensured that, during makeup, the discharging is smooth and reliable. Therefore, the discharging of the powder jar is on demand for makeup, thereby achieving a coordinated control of automatic opening and closing.

In the automatic opening-and-closing discharging structure design for a powder jar of the present invention, the most distinctive feature thereof is as follows. During the whole discharging control, through the correspondingly disposed porous faces 31 and 22 on the plate faces of the overlapped upper movable trough plate 30 and lower fixed trough plate 20 and by a rotation operation of the jar cover 11, the movable trough plate 30 is rotated when the jar cover 11 is screwed and closed, thereby making the connected upper and lower through holes dislocated. In addition, the discharging holes are sealed by moving and engaging the flanges 36 at the bottom face of the movable trough plate 30, thereby synchronously and reliably closing the discharging. Through the long arc groove 23 and the short arc groove 24 disposed on the plate face of the overlapped lower fixed trough plate 20, the inserted column 32 on the bottom of the movable trough plate 30 can directionally slide in the arc grooves, and the groove length is used as a displacement limit for sliding. When the jar cover 11 is screwed and closed, the inserted column 32 inserted in the long arc groove 23 rests against the elastic member 25 simultaneously, thereby making the elastic member 25 in a compressed energy storage state. During makeup, when the jar cover 11 is opened by rotating and the locking is released, the elasticity of the elastic member 25 is recovered to push the inserted column 32 back to the groove edge at the other side. That is, the length of the elastic member 25 returns to a normal extending state, so that the movable trough plate 30 is really pushed back to the original overlapped position, i.e. the position where the upper porous face 31 and the lower porous face 22 are connected, thereby making it smooth to discharge the contained powder material and making it convenient to do makeup. Through the groove length limit of the long arc groove 23 and the short arc groove 24, the rotational displacement of the movable trough plate 30 can achieve a stable and automatic elastic recovery reciprocating movement, thereby ensuring that the operations of opening and closing powder jar can achieve the operations of synchronously and automatically opening and closing the discharging of the contained powder material. This is convenient for makeup and can ensure that the contained cosmetic material is discharged on demand of makeup for adhering. After makeup, cosmetic brushes can be placed on the concave central plate face of the movable trough plate 30. As the discharging porous face 31 is closed, no cosmetic powder material will run out, which prevents the brushes from being polluted and can further ensure the storage safety of the contained cosmetic powder material and the beautiful appearance of the packing jar. Thus, the structure of the present invention actually complies with the practical cosmetic demand, and is especially convenient for a user to store and carry when going outside, so that the usage of a powder material packing container really achieves a practical and convenient use effect. The production and assembly of the whole jar structure are very simple and easy, and the design is really an innovative structure design directed to automatic opening-and-closing discharging control in the field of powder jar packing.

I claim:

1. An automatic opening-and-closing discharging structure for a loose powder jar, comprising a packing jar body for storing a powder material and a jar cover thereof, wherein:

a group of overlapped upper and lower trough plates respectively having a discharging porous face is disposed at an edge of a filling port of the jar body;

concave positioning notches are uniformly disposed at an inner edge of the filling port on a top of the jar body, so that a fixed trough plate is placed, inserted and positioned, wherein concave long and short arc grooves are respectively disposed at an external perimeter of a discharging porous face on a central plate face of the fixed trough plate, and elastic member is disposed in the long arc groove;

at positions corresponding to the long and short arc grooves on a bottom of a movable trough plate overlapped above the fixed trough plate, convex inserted columns are respectively inserted into the arc grooves to form an overlapped rotation guide, wherein, when rotating, the inserted column inserted in the long arc groove rests against and pushes the elastic member to perform an operation of compression and contraction for energy storage, so that convex points arranged at intervals above a top-edge ring plate of the movable trough plate can be engaged and jointly rotated with the corresponding circularly-arranged convex points on the jar cover; and when the jar cover is screwed, the movable trough plate is rotated simultaneously, so that the upper and lower porous faces on the overlapped trough plates are dislocated and disconnected to suspend the discharging operation, and when the jar cover is opened, through an elastic recovery of the elastic member in the long arc groove, a hole opening of the porous face of the movable trough plate returns to the overlapped connection position, so that the filled powder material is discharged smoothly for the convenience of makeup, and thus the discharging of the powder jar is performed based on a makeup demand, thereby forming a safe operation structure capable of being automatically opened and closed.

2. The automatic opening-and-closing discharging structure for a loose powder jar of claim 1, wherein a concave axle center groove is disposed at a center of the fixed trough plate.

3. The automatic opening-and-closing discharging structure for a loose powder jar of claim 1, wherein the elastic member is a spring.

4. The automatic opening-and-closing discharging structure for a loose powder jar of claim 1, wherein a convex axle column is disposed at the center of the bottom of the movable trough plate and is inserted in the concave axle center groove disposed at the center of the fixed trough plate, thereby stably controlling an overlapped rotation.

5. The automatic opening-and-closing discharging structure for a loose powder jar of claim 1, wherein at the bottom of the movable trough plate, slightly convex flanges are distributed at intervals of the discharging holes, so that when the overlapped upper and lower holes on the trough plates are dislocated and disconnected by rotating to suspend the discharging, the flanges are just inserted in opening edges of the discharging holes of the fixed trough plate to form a seal for the discharging.

6. The automatic opening-and-closing discharging structure for a loose powder jar of claim 1, wherein the long and short arc grooves are disposed oppositely at regular intervals.

7. The automatic opening-and-closing discharging structure for a loose powder jar of claim 1, wherein the convex points are respectively disposed at a circularly-arranged bottom of the fixed trough plate corresponding to the positioning notches.

8. The automatic opening-and-closing discharging structure for a loose powder jar of claim 5, wherein sphere arc-shaped convex-granule surfaces of the flanges are slightly convex.

* * * * *